United States Patent [19]

Ziegner

[11] Patent Number: 4,611,186

[45] Date of Patent: Sep. 9, 1986

[54] NONCONTACTING MIC GROUND PLANE COUPLING USING A BROADBAND VIRTUAL SHORT CIRCUIT GAP

[75] Inventor: Bernhard A. Ziegner, Westford, Mass.

[73] Assignee: Motorola, Inc., Schaumburg, Ill.

[21] Appl. No.: 759,519

[22] Filed: Jul. 29, 1985

Related U.S. Application Data

[63] Continuation of Ser. No. 530,291, Sep. 8, 1983, abandoned.

[51] Int. Cl.[4] ..... H01P 5/00

[52] U.S. Cl. ..... 333/246; 333/260; 339/14 R; 361/399; 361/415; 174/52 R

[58] Field of Search ..... 333/246, 247, 260, 24 R; 361/399, 401, 415; 174/52 R, 33 R; 339/14 R, 17 R; 357/74

[56] References Cited

U.S. PATENT DOCUMENTS

| | | | |
|---|---|---|---|
| 2,451,876 | 10/1948 | Salisbury | 333/250 X |
| 3,553,610 | 1/1971 | Brenner et al. | 333/250 X |
| 3,747,044 | 7/1973 | Vaccaro | 339/14 R |
| 3,852,690 | 12/1974 | Telfer | 333/33 X |
| 3,870,974 | 3/1975 | Ohlstein et al. | 333/238 X |
| 4,100,516 | 7/1978 | Hall | 333/246 X |
| 4,255,730 | 3/1981 | Sekine et al. | 333/247 |

FOREIGN PATENT DOCUMENTS

| | | | |
|---|---|---|---|
| 197805 | 11/1976 | Fed. Rep. of Germany | 333/246 |
| 0103501 | 8/1981 | Japan | 333/254 |
| 0708442 | 1/1980 | U.S.S.R. | 333/246 |

*Primary Examiner*—Eugene R. LaRoche
*Assistant Examiner*—Benny Lee
*Attorney, Agent, or Firm*—Eugene A. Parsons

[57] ABSTRACT

Electrical coupling to the ground plane of an MIC is accomplished by forming a gap adjacent an edge of the ground plane and causing a virtual short to appear across the gap. A two part, one-half wavelength transmission line transformer is used to provide the virtual short. The transformer is defined by the conductive members surrounding the MIC and is open at the end corresponding to the gap and shorted at the other end. The impedances of the two parts of the transformer are chosen to maximize the bandwidth of the virtual short.

4 Claims, 8 Drawing Figures

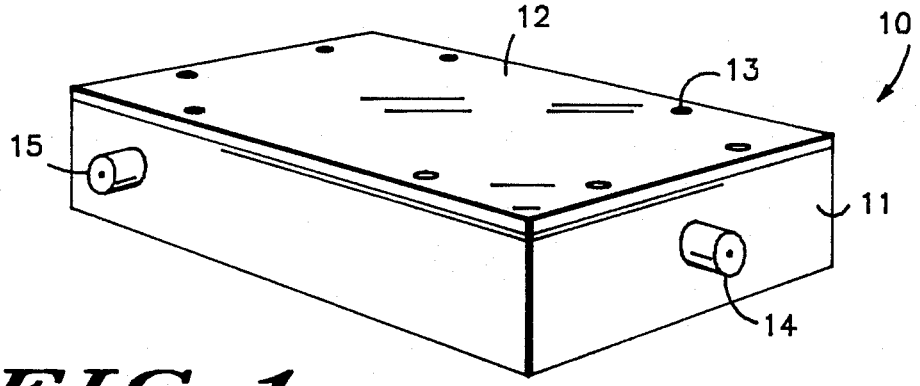
FIG. 1
FIG. 2
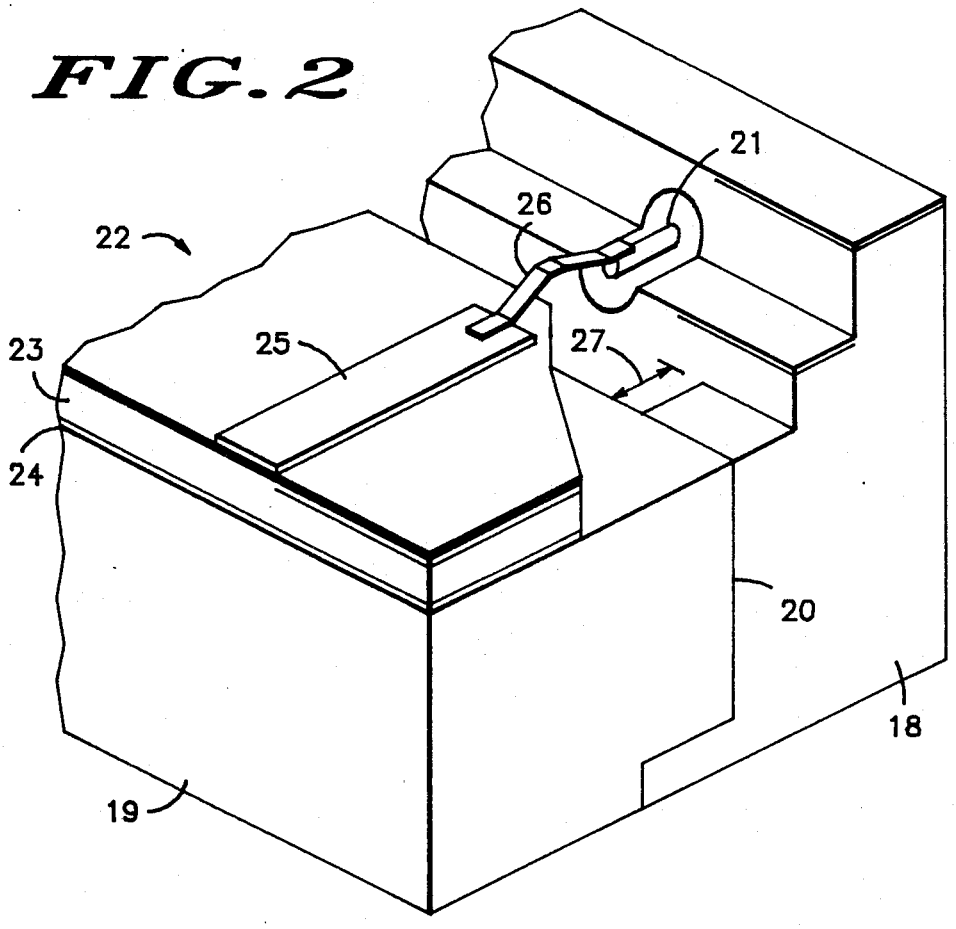

FIG. 3
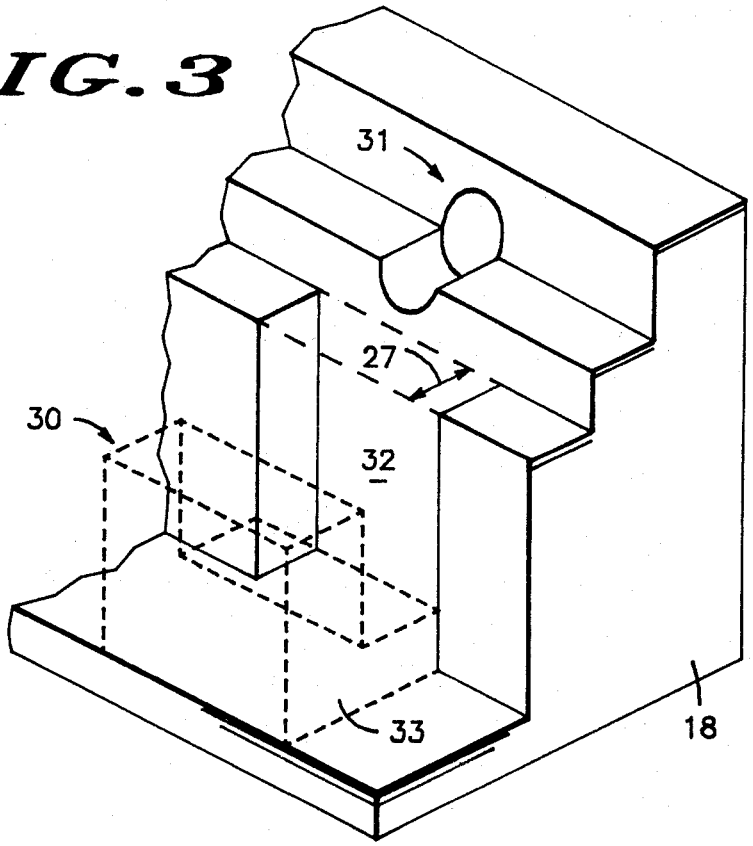
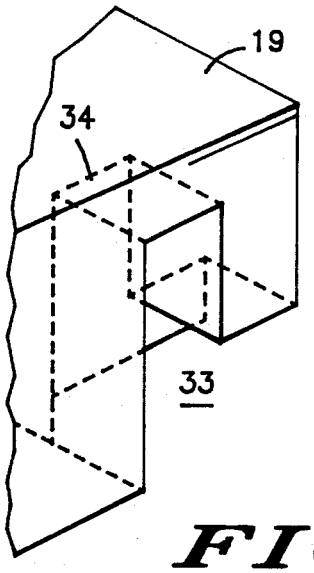
FIG. 4
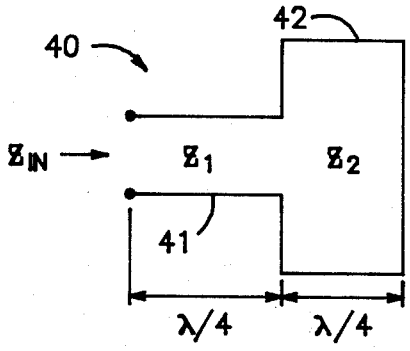
FIG. 6

NONCONTACTING MIC GROUND PLANE COUPLING USING A BROADBAND VIRTUAL SHORT CIRCUIT GAP

This application is a continuation of application Ser. No. 530,291 filed Sept. 8, 1983, now abandoned.

FIELD OF THE INVENTION

The present invention relates, in general, to an apparatus and method for electrically coupling to and from the ground planes of microwave integrated circuits and the like. More particularly, the invention relates to such an apparatus and method which decreases the importance of high tolerance mechanical connections in determining the electrical performance of the coupling.

BACKGROUND OF THE INVENTION

MIC's generally comprise a substrate carrying signal lines and/or electronic devices on one side and a ground plane on the other. A second substrate and ground plane is added in the case of a stripline circuit. Whenever signals are coupled from one MIC to another within a package or from a coaxial cable to an MIC inside a package, there is a problem of providing an electrically adequate connection between the two ground planes or the ground plane and the outer conductor of the cable.

Direct physical connections generally require close tolerance machining or other measures which are incompatible with the goals of lowering the cost and increasing the modularity of systems including MIC's.

SUMMARY OF THE INVENTION

Accordingly, it is an object of the present invention to provide an improved apparatus and method for MIC ground plane coupling.

A further object of the present invention is to provide a noncontacting MIC ground plane coupling.

Yet a further object of the present invention is to provide a ground plane coupling for microwave circuits which does not depend on close tolerance machined interfaces.

A particular embodiment of the present invention comprises an apparatus and method for coupling a coaxial cable to an MIC. A standard panel feedthrough connector is used to bring the center conductor of the cable through the side wall of the MIC package and to connect the outer conductor of the cable to the package wall. The center conductor is connected to the signal line of the MIC by a wire or ribbon bond. A gap is formed under the wire or ribbon between the edge of the ground plane and the wall of the package. The gap represents the open end of a two-part, one-half wavelength transformer formed by the mating portions of the package. Each part of the transformer is essentially a one-quarter wavelength waveguide section. The portion adjacent the gap has a relatively low impedance and the other portion has a relatively high impedance and is shorted at the far end. The result of properly selecting the characteristics of the two portions of the transformer is a broadband virtual short across the gap between the ground plane and the wall of the package. This provides good coupling between the outer conductor of the cable and the ground plane.

Another embodiment of the present invention comprises an apparatus and method for coupling the ground planes of two adjacent MICs. The MICs are arranged on their respective bases so that when the bases abut a gap exists between the substrate edges in the region of the interconnection. The signal lines are connected across the gap by a wire or ribbon bond. The gap is the open end of a two-part transformer as described above which is formed by the two mating bases on which the MICs are mounted.

These and other objects and advantages of the present invention will be apparent to one skilled in the art from the detailed description below taken together with the drawings.

BRIEF DESCRIPTION OF THE DRAWINGS

FIG. 1 is a perspective view of a typical MIC package having coaxial cable connectors;

FIG. 2 is a perspective cross-sectional view of a portion of the interior of a packaged MIC illustrating a ground plane coupling according to the principles of the present invention;

FIG. 3 is a perspective cross-sectional view of a portion of the MIC package shown in FIG. 2;

FIG. 4 is a perspective cross-sectional view of a portion of the MIC base which forms a part of the package and coupling of FIG. 2;

FIG. 6 is a schematic representation of a two-part transmission line transformer;

DETAILED DESCRIPTION OF THE INVENTION

Figure 5:
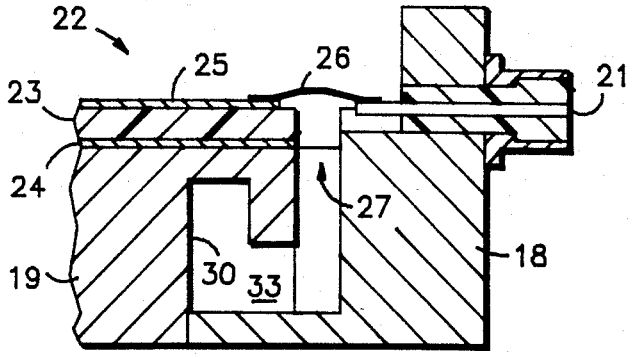
FIG. 5 is a cross-sectional view of the apparatus of FIG. 2.

A typical MIC package assembly 10 is shown in a perspective view in FIG. 1. Assembly 10 comprises a conductive housing having a lower portion 11 and an upper portion, or lid, 12 which is typically affixed to lower portion 11 by means of threaded fasteners 13. Electrical signals are coupled into and out of assembly 10 by means of coaxial cable connectors 14 and 15. Connectors 14 and 15 each provide a center pin for coupling to the center conductor of a coaxial cable. The center pin extends through lower portion 11 of the MIC package and is insulated therefrom. The outer conductor of the coaxial cable is connected to the outer, conductive portion of connectors 14 and 15 and thereby to lower portion 11 of the MIC package.

FIG. 2 is a perspective cross-sectional view of a portion of the inside of a MIC package assembly illustrating a ground plane coupling according to the principles of the present invention. The lower portion of the MIC package is divided into a wall portion 18 and a base portion 19 which abut along an interface 20. Center pin 21 of a standard coaxial connector extends through wall portion 18 and is insulated therefrom. A MIC 22 comprises a substrate 23, a ground plane 24 and a signal line 25. MIC 22 is carried on base portion 19 of the MIC package and ground plane 24 is in contact therewith. A wire or ribbon bond 26 connects signal line 25 to center pin 21.

A portion of substrate 23 and ground plane 24 are shown cutaway in FIG. 2 to reveal a gap 27 between the edge of base portion 19 and the face of wall portion 18 immediately underlying wire bond 26. Since ground plane 24 is coincident with the edge of base portion 19, gap 27 may be equally well defined by the edge of ground plane 24 and the surface of wall portion 18. The function of gap 27 is further described with reference to the figures below. In short, the purpose of gap 27 is to provide an effective and reliable electrical coupling between ground plane 24 and wall portion 18 and thereby to the outer conductor of the coaxial cable.

Referring now to FIG. 3, wall portion 18 of the apparatus of FIG. 2 is shown in the same perspective cross-sectional view with the remainder of the apparatus removed. A cavity 30, which is partially defined by wall portion 18 and partially defined by base portion 19, is shown in phantom. Gap 27, which is substantially centered under aperture 31 through which the center pin of the coaxial connector extends, forms the open end of a first portion 32 of cavity 30. At the opposite end from gap 27 first portion 32 of cavity 30 couples with second portion 33 of cavity 30. As is described below with reference to FIG. 6, cavity 30 forms a two-part, one-half wavelength transformer which creates a virtual short across gap 27, thus providing electrical coupling between ground plane 24 and wall 18 in the coupling region.

Referring now to FIG. 4, base portion 19 of the apparatus of FIG. 2 is shown from the same perspective as FIG. 2 but sectioned along a plane roughly coincident with the axis of aperture 31 in wall portion 18. Inner surface 34 of base portion 19 defines a shorted end of second cavity portion 33. As is apparent, second cavity portion 33 is somewhat larger than first portion 32. As is discussed below, this is an impedance selecting technique. Both cavity portions are treated as waveguide section whose widths are chosen according to the frequency of operation and whose heights are chosen according to the desired impedance. Of course, within these constraints, the arrangement of the two cavities within the base portions is only one of many possible arrangements.

Finally, FIG. 5 is a cross-sectional view of the apparatus of FIG. 2 taken along the center line of the coaxial feedthrough. This view more clearly shows how wall portion 18 and base portion 19 combine to form first portion 32 and second portion 33 of cavity 30. As was described above, gap 27 between ground plane 24 and wall portion 18 forms an open end of cavity 30. Center pin 21 extends through wall portion 18 and is connected to signal line 25 by ribbon bond 26.

The electrical performance of the two-part cavity transformer defined by wall portion 18 and base portion 19 can be modeled by use of the schematic diagram of FIG. 6. FIG. 6 depicts a two-part, one-half wavelength transmission line transformer 40. A first part 41 is a transmission line section one-quarter wavelength long having an impedance $Z_1$. A second part 42 is a transmission line section one-quarter wavelength long having an impedance $Z_2$. First transmission line section 41 is open-circuited at one end and coupled to second transmission line section 42 at the other. The far end of second transmission line section 42 is shorted. For the single frequency at which the overall length of transformer 40 is precisely one-half wavelength, the input impedance $Z_{in}$ is equal to zero. Thus if the open end of first transmission line section 41 corresponds to gap 27 of FIG. 2, then a virtual short exists across gap 27 and ground plane 24 is effectively coupled to wall portion 18. However, this alone does not provide a sufficiently broadband virtual short across gap 27 for a practical system. In order to achieve a virtual short across a relatively broad band of frequencies, it is necessary to select the relationship between $Z_1$ and $Z_2$. Equation (1) provides the relationship by which this choice may be made:

$$X = \frac{(1+m)\tan\frac{\pi B}{1+B}}{\left(m\tan^2\frac{\pi B}{1+B}\right)-1}, \quad (1)$$

where $X = Z_{in}/Z_1$, $m = Z_2/Z_1$, $B = F_2/F_1$ ($F_2 = F_1 +$ bandwidth), and the expression is in radian units.

$F_1$ and $F_2$ are frequencies defining lower and upper bounds, respectively, of the passband.

By manipulating $Z_1$ and $Z_2$ and using equation (1) it is possible to maintain a reasonable bandwidth B and to minimize the reactive component of the impedance appearing across gap 27.

In the embodiment described above the two transmission line sections which form the transformer are essentially waveguide sections. Thus, the width of the waveguides must be sufficient to support propagation at the frequencies of interest. In other words, the width is roughly seven tenths of the wavelength of the lowest frequency at which the coupling is to perform. In addition, the impedance of the waveguide sections is determined by the height thereof according to well known relationships. Thus, once equation (1) is used to determine the impedances of the two waveguide sections all of the dimensions necessary to machine wall portion 18 and base portion 19 are readily calculated.

As is apparent to one skilled in the art, a two-section transmission line transformer comprising two waveguide sections may be formed in many different shapes and arrangements by two mating MIC enclosure portions. It is important that no interface between wall portion 18 and base portion 19 occur at a point of maximum current in the transformer. That is, the waveguide sections should not be arranged so that the interface occurs at the shorted end of the transformer. Ideally, any seams in the walls of the transformer should occur at a minimum current point, or one quarter wavelength from the shorted end.

Figure 7:
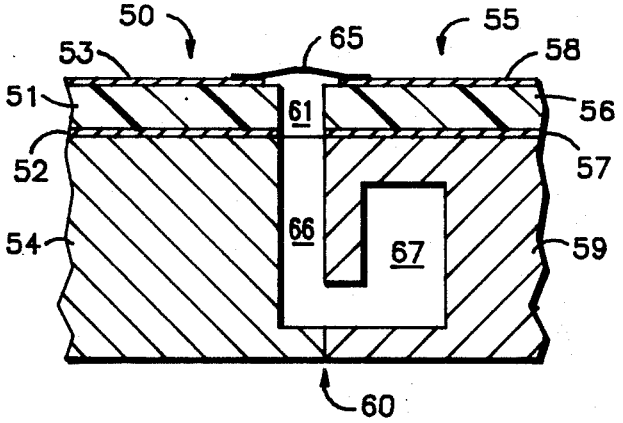
FIG. 7 is a cross-sectional view of a MIC-to-MIC ground plane coupling according to the principles of the present invention.
Figure 8:
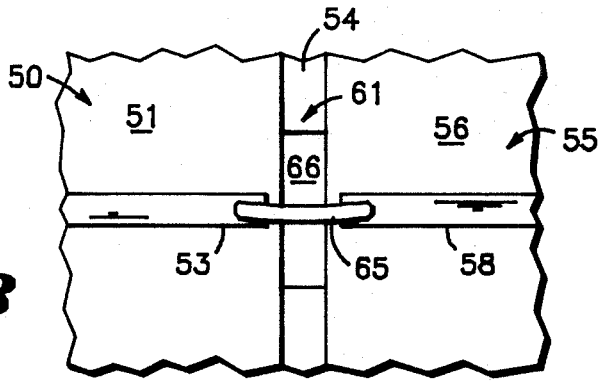
FIG. 8 is a plan view of the apparatus of FIG. 6.

Referring now to FIGS. 7 and 8 an alternate embodiment of the present invention is described. In this embodiment a first MIC 50 is to be coupled to a second MIC 55. First MIC 50 comprises a dielectric substrate 51, a ground plane 52 and a signal line 53. Similarly, second MIC 55 comprises a dielectric substrate 56, a ground plane 57 and a signal line 58. MIC 50 is mounted on a conductive base 54 and MIC 55 is mounted on a conductive base 59.

Bases 54 and 59 are machined so that when they abut at interface 60, MIC 50 and MIC 55 are separated by a gap 61. A wire bond 65 connects signal line 53 to signal line 58. Ground plane 52 and ground plane 57 are opposed across gap 61 at the open end of a first waveguide section 66 defined by bases 54 and 59. At the end of waveguide 66 opposite gap 61 it is coupled to a second waveguide section 67 defined primarily in base 59. As in the embodiment described above, waveguide sections 66 and 67 comprise a two-part, one-half wavelength transformer. The purpose of the transformer is, as before, to provide a relatively broadband virtual short at the open end of waveguide section 66, that is, between ground plane 52 and ground plane 57. The design considerations of this embodiment are substantially the same as those described above.

While the present invention has been particularly shown and described with reference to two particular embodiments thereof, various modifications and changes may be made by those skilled in the art within the spirit and scope of the present invention.

I claim:

1. An apparatus for electrically coupling to a ground plane of an MIC comprising:

a first conductive member, said MIC being mounted thereon with said ground plane in contact therewith, said ground plane being substantially coincident with an edge of said first member in a coupling region, said first conductive member having a first cavity portion;

a second conductive member having a second cavity portion, said second conductive member being abutted against said first conductive member to provide that said first and second cavity portions combine to form;

a gap between said first and second conductive members at said coupling region;

a first waveguide section having a first end coincident with said gap;

and a second waveguide section, said first and second wave guide sections combining to cause a broadband virtual short across said gap, whereby said ground plane is electrically coupled to said second conductive member across said gap.

2. An apparatus according to claim 1 wherein:

said first and second conductive members form base and wall portions, respectively, of an MIC enclosure and said ground plane is electrically coupled to an outer conductor of a coaxial connector mounted to said wall portion.

3. An apparatus according to claim 1 wherein:

said first and second conductive members form a base of said MIC and a base of an adjacent MIC, respectively, said ground plane said MIC being electrically coupled across said gap to a ground plane of said adjacent MIC.

4. An apparatus according to claim 1 wherein:

said first waveguide section has a length of approximately one quarter wavelength at a first frequency and has a first impedance; and said second waveguide section has a length of approximately one quarter wavelength at said first frequency and has second impedance, said first and second impedances being chosen to maximize a bandwidth of said virtual short across said gap.

* * * * *